US007698910B2

(12) United States Patent
Kim et al.

(10) Patent No.: US 7,698,910 B2
(45) Date of Patent: Apr. 20, 2010

(54) DOOR AND A DRUM TYPE WASHING MACHINE AND A CLOTHES DRYER USING THE SAME

(75) Inventors: Jong Seok Kim, Changwon-shi (KR); Yang Hwan No, Changwon-shi (KR); Han Ki Cho, Changwon-shi (KR); Yeon Su Jung, Changwon-shi (KR); Jung Hoon Kang, Changwon-shi (KR); Myung Sik Park, Changwon-shi (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/320,909

(22) Filed: Dec. 30, 2005

(65) Prior Publication Data

US 2006/0156767 A1 Jul. 20, 2006

Related U.S. Application Data

(63) Continuation of application No. 10/471,373, filed as application No. PCT/KR03/00037 on Jan. 9, 2003, now abandoned.

(30) Foreign Application Priority Data

Jan. 9, 2002 (KR) ..... 10-2002-0001297

(51) Int. Cl.
*D06F 33/00* (2006.01)

(52) U.S. Cl. ..... 68/12.01; 68/142

(58) Field of Classification Search ..... 68/12.01, 68/142

See application file for complete search history.

(56) References Cited

U.S. PATENT DOCUMENTS

| | | | | |
|---|---|---|---|---|
| 2,311,645 | A | 2/1943 | Dempsey et al. | |
| 2,771,627 | A | 11/1956 | Hammer | |
| 2,793,386 | A | 5/1957 | Muhlhauser | |
| 3,439,452 | A | 4/1969 | Kain | |
| 4,586,762 | A | 5/1986 | Kennedy et al. | |
| 4,681,357 | A | 7/1987 | Uemura et al. | |
| 5,074,009 | A | 12/1991 | Simonton et al. | |
| 5,134,754 | A | 8/1992 | Vickers | |
| 5,195,647 | A | 3/1993 | Studt | |
| 5,496,104 | A | 3/1996 | Arnold et al. | |
| 6,010,167 | A | 1/2000 | Tanimoto et al. | |
| 6,057,534 | A * | 5/2000 | Lee | 219/739 |
| 6,185,785 | B1 | 2/2001 | Kingston | |
| 6,256,823 | B1 * | 7/2001 | Kronbetter et al. | 8/158 |

(Continued)

FOREIGN PATENT DOCUMENTS

EP 0 293 984 B1 12/1991

(Continued)

*Primary Examiner*—Michael Barr
*Assistant Examiner*—Jason Heckert
(74) *Attorney, Agent, or Firm*—McKenna Long & Aldridge LLP

(57) ABSTRACT

A door for a washing appliance is provided. The door includes an inner frame and an outer frame joined with the inner frame where one of the frames couples with a cabinet of the washing appliance. The door also has a glass door between the inner frame and the outer frame and a recess portion disposed in an inner circumferential surface of the outer frame.

23 Claims, 7 Drawing Sheets

U.S. PATENT DOCUMENTS

| | | | | |
|---|---|---|---|---|
| 6,609,274 | B2 | 8/2003 | Christensen et al. | |
| 6,849,094 | B1 | 2/2005 | North | |
| 2003/0110591 | A1 * | 6/2003 | Christensen et al. | 16/412 |

FOREIGN PATENT DOCUMENTS

| | | | | |
|---|---|---|---|---|
| EP | 0 610 824 | B1 | | 8/1996 |
| EP | 0610824 | B1 | | 8/1996 |
| EP | 1266993 | A | | 12/2002 |
| GB | 941134 | | | 6/1963 |
| GB | 2221151 | A | | 1/1990 |
| GB | 2320507 | | * | 1/1997 |
| GB | 2320507 | A | | 6/1998 |
| JP | 56-130198 | | * | 10/1981 |
| JP | 60-21800 | | | 2/1985 |
| JP | 60-021800 | | | 2/1985 |
| JP | 3-49092 | | | 5/1991 |
| JP | 09-126472 | | | 5/1997 |
| JP | 09126472 | A | * | 5/1997 |
| JP | 10-241855 | | | 9/1998 |
| JP | 2001-288936 | | | 10/2001 |

* cited by examiner

DOOR AND A DRUM TYPE WASHING MACHINE AND A CLOTHES DRYER USING THE SAME

This application is a continuation of U.S. patent application Ser. No. 10/471,373, filed Sep. 9, 2003 now abandoned, which claims priority to International Patent Application No. PCT/KR2003/00037 filed on Jan. 9, 2003, which claims priority to Korean Patent Application No. 10-2002-0001297 filed on Jan. 9, 2002, all of which are hereby incorporated by reference, as if fully set forth herein.

TECHNICAL FIELD

The present invention relates to a door and a drum type washing machine and a clothes drier using the same.

BACKGROUND ART

The washing machine performs washing, rinsing and spinning processes for taking dirt off the clothes by using action of detergent and water. There are drum type, agitator type and pulsator type in the washing machines.

The drum type washing machine carries out washing by slowly rotating the drum around a horizontal axis in a state the detergent, the washing water, and the laundry are introduced into an inside of the drum having a plurality of tumbling ribs formed thereon so that the washing of the laundry is made by falling down impact of the laundry after being lifted by the tumbling ribs and friction force.

The drum type washing machine is used widely day by day because the drum type washing machine causes almost no damage to the laundry and no entangling of the laundry, and consumes a small amount of water.

The clothes drier dries a drying object by blowing hot air produced from a heater into the drum to evaporate moisture in the drying object. In the clothes drier, there are air discharging type, and air condensing type clothes driers depending on a system of processing moist air produced during the drying object is dried.

The air discharge type clothes drier discharges the moist air from the drum to outside of the drier, and the condensing type clothes drier condenses the moist air from the drum, to remove moisture from the air, and blows the dried air into the drum again, for re-circulating the air.

Those drum type washing machine and drier are provided with doors for preventing the laundry and the drying object, such as clothes, from being thrown out. A related art door will be described, with reference to the attached drawings.

Referring to FIG. 1, the door 10 is provided with an inner frame 12 having a hinge assembly 5 connected thereto for opening/closing of the door 10, and an outer frame 14. The inner frame 12 and the outer frame 14 are fastened with bolts 11, and there is a door glass 13 between the inner frame 12 and the outer frame 14. Accordingly, the door glass 13 is fixed by the inner frame 12 and the outer frame 14 at a circumference thereof.

The inner frame 12 has a hook 15 and a hook hole 12*h* for opening/closing the door 10, and the outer frame 14 has a handle 14*a* at one side thereof for opening/closing the door 10. The handle 14*a* is projected from one end of the outer frame 14.

The projection of the handle from the one end of the outer frame 14 impairs an overall appearance of the drum washing machine and the clothes drier.

DISCLOSURE OF INVENTION

The object of the present invention is to provide a door having a handle recessed in the outer frame, and a drum type washing machine or a drier by using the door, for improving an overall appearance.

The object of the present invention can be achieved by providing a door including a hinge assembly, an inner frame and an outer frame joined together at least one thereof is connected to the hinge assembly, a transparent door glass having an edge positioned between, and fixed to, the inner frame and the outer frame, and a handle formed in a form of a recess so that fingers are put into the outer frame from an exterior and pulling the outer frame.

The inner frame and the outer frame have ring forms, and the handle has a plurality of projections on a surface thereof.

The handle has a finger recess in an inside thereof so that ends of the fingers are inserted therein and caught at the finger recess when the fingers are put therein.

The handle is formed on an inner circumferential surface of the outer frame, and the outer frame has a sloped inner circumferential surface for exposing an opening of the handle, or an outside surface opposite to a part the handle is formed therein formed of a transparent material for making the handle visible.

The handle is fabricated separately, and detachably inserted in a cavity recessed in the inner circumferential surface of the outer frame.

The handle is formed in an outside surface of the outer frame, and the handle is fabricated separately, and detachably inserted in a cavity recessed in the outside surface of the outer frame.

In another aspect of the present invention, there is provided a drum type washing machine including a cabinet, a tub and a drum mounted inside of the cabinet for washing laundry, a motor for rotating the drum, a hinge assembly provided to a point in the vicinity of an opening in the cabinet, an inner frame and an outer frame joined together at least one thereof connected to the hinge assembly, a transparent door glass having an edge between, and fixed to the inner frame and the outer frame, and a handle formed in a form of a recess so that fingers are put into the outer frame from an exterior and pulling the outer frame.

In further aspect of the present invention, there is provided a clothes drier including a cabinet, a drying drum rotatably mounted in the cabinet, a plurality of ducts of an air circulation passage for drying a drying object in the drum, a heater for heating the air, a blower for circulating the air, a hinge assembly provided to a point in the vicinity of an opening in the cabinet, an inner frame and an outer frame joined together at least one thereof connected to the hinge assembly, a transparent door glass having an edge between, and fixed to the inner frame and the outer frame, and a handle formed in a form of a recess so that fingers are put into the outer frame from an exterior and pulling the outer frame.

BRIEF DESCRIPTION OF DRAWINGS

The accompanying drawings, which are included to provide a further understanding of the invention, illustrate embodiments of the invention and together with the description serve to explain the principles of the invention.

In the drawings.

BEST MODE FOR CARRYING OUT THE INVENTION

Reference will now be made in detail to the preferred embodiments of the present invention, examples of which are illustrated in the accompanying drawings.

Figure 1:
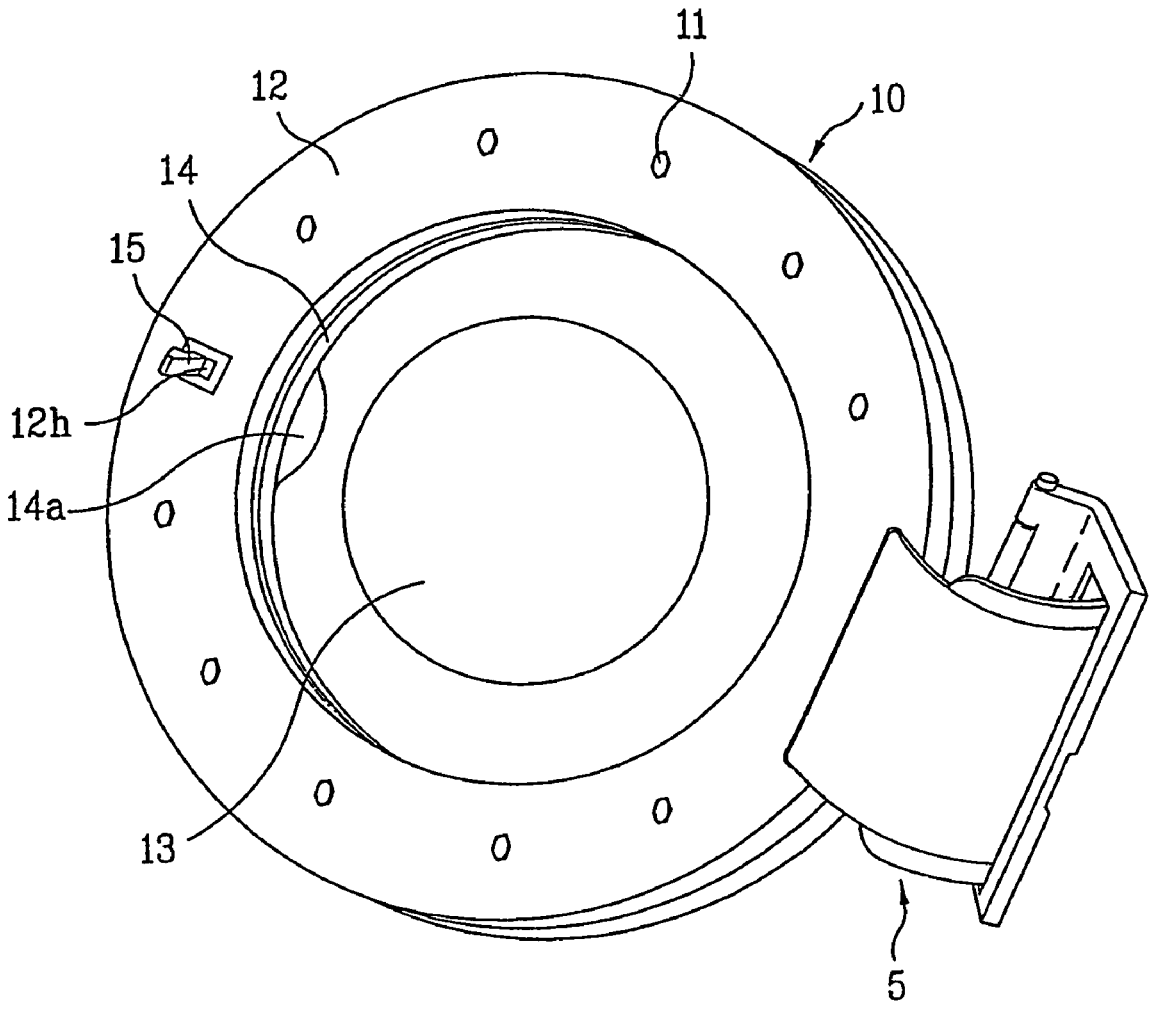
FIG. 1 illustrates a perspective view of a related art door.
Figure 2:
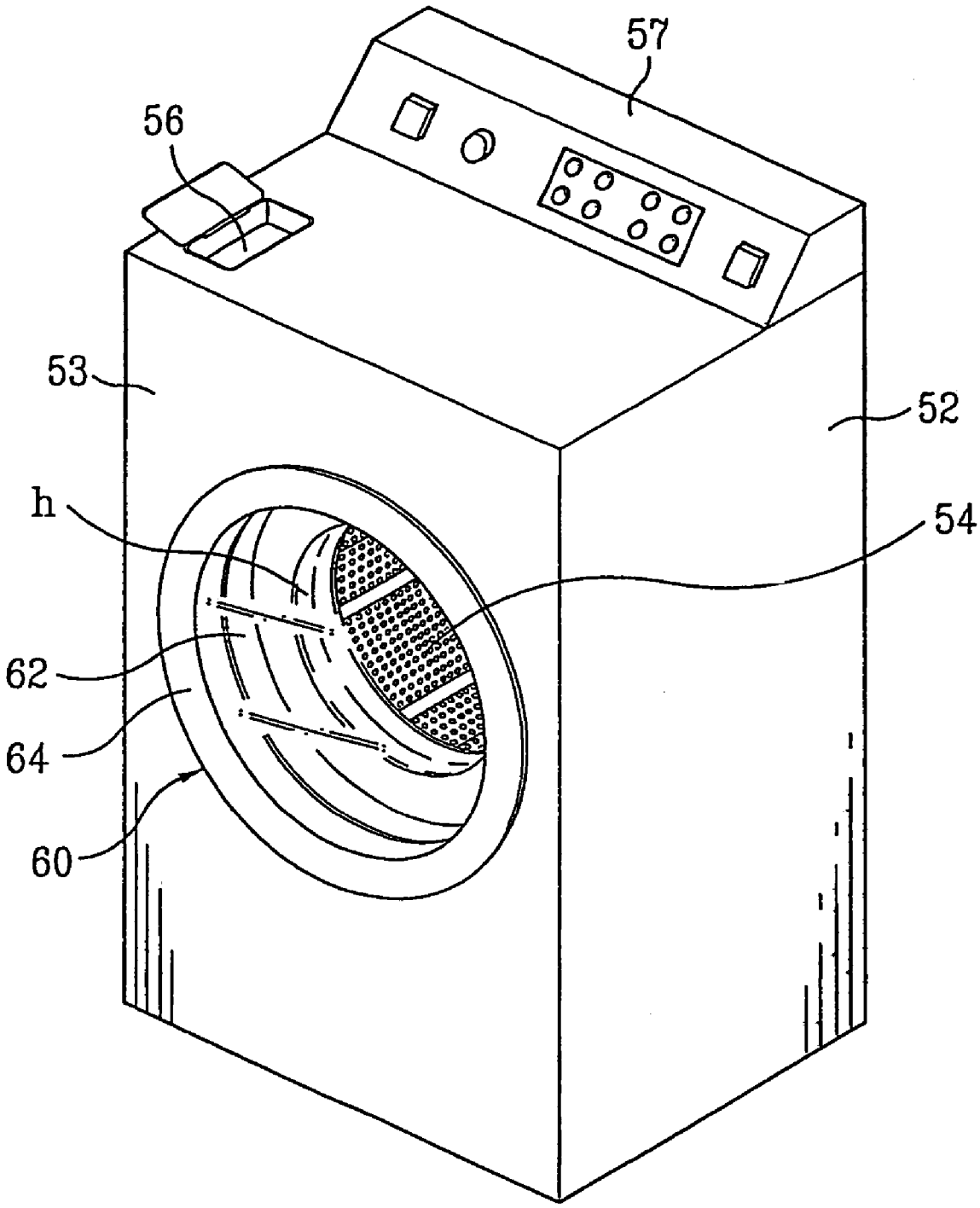
FIG. 2 illustrates a perspective view of a drum type washing machine having the door of the present invention applied thereto.

Referring to FIG. 2, the drum type washing machine of the present invention includes a tub (not shown) mounted inside of a cabinet 52 having an opened front part for making washing of laundry, and a drum 54 rotatably mounted on a central part of the tub. The drum 54 is disposed horizontally, or a rear side thereof is sloped downwardly, and the drum 54 is driven by a motor (not shown).

There is a cabinet cover 53 in the front part of the cabinet 52 having an opening h for depositing/taking the laundry into/out of the drum 54. There is the open/closable door 60 mounted on the cabinet cover 53 for preventing the laundry from being thrown off the drum 54.

There is a detergent hold 56 in one side of a top part of the cabinet 52 for storing detergent to be introduced into an inside of the tub, and a control panel 57 on the cabinet 52 for operation of the washing machine.

Figure 4:
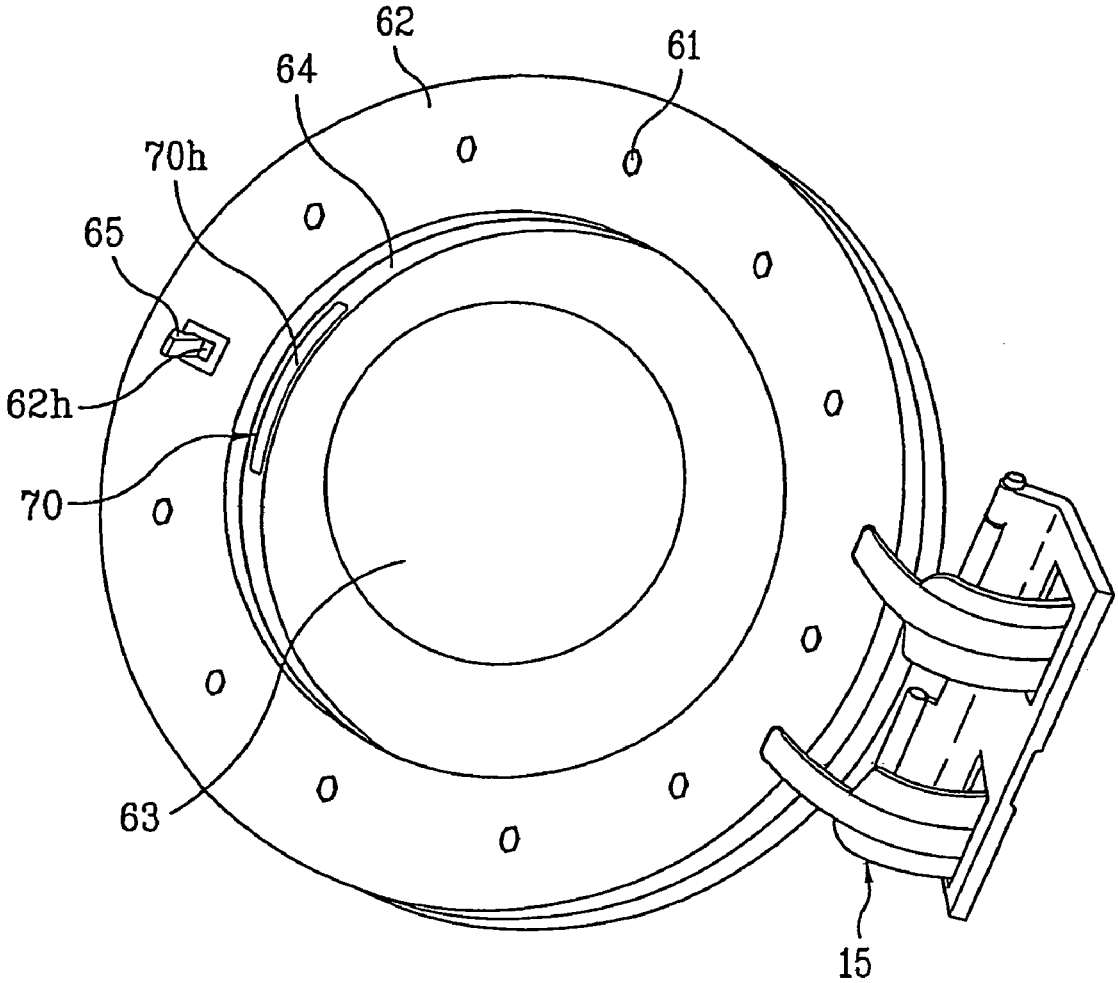
FIG. 4 illustrates a perspective view of a door in accordance with a preferred embodiment of the present invention.

Referring to FIG. 4, the door 60 includes a hinge assembly 15 fitted to one point of a circumference of the opening in the cabinet 52, and an inner frame 62 and an outer frame 64 joined together having at least one thereof connected to the hinge assembly 15.

The outer frame 64 includes a handle 70 at a side of the opening h in the cabinet cover 53 so that the user can open/close the door 60.

Figure 3:
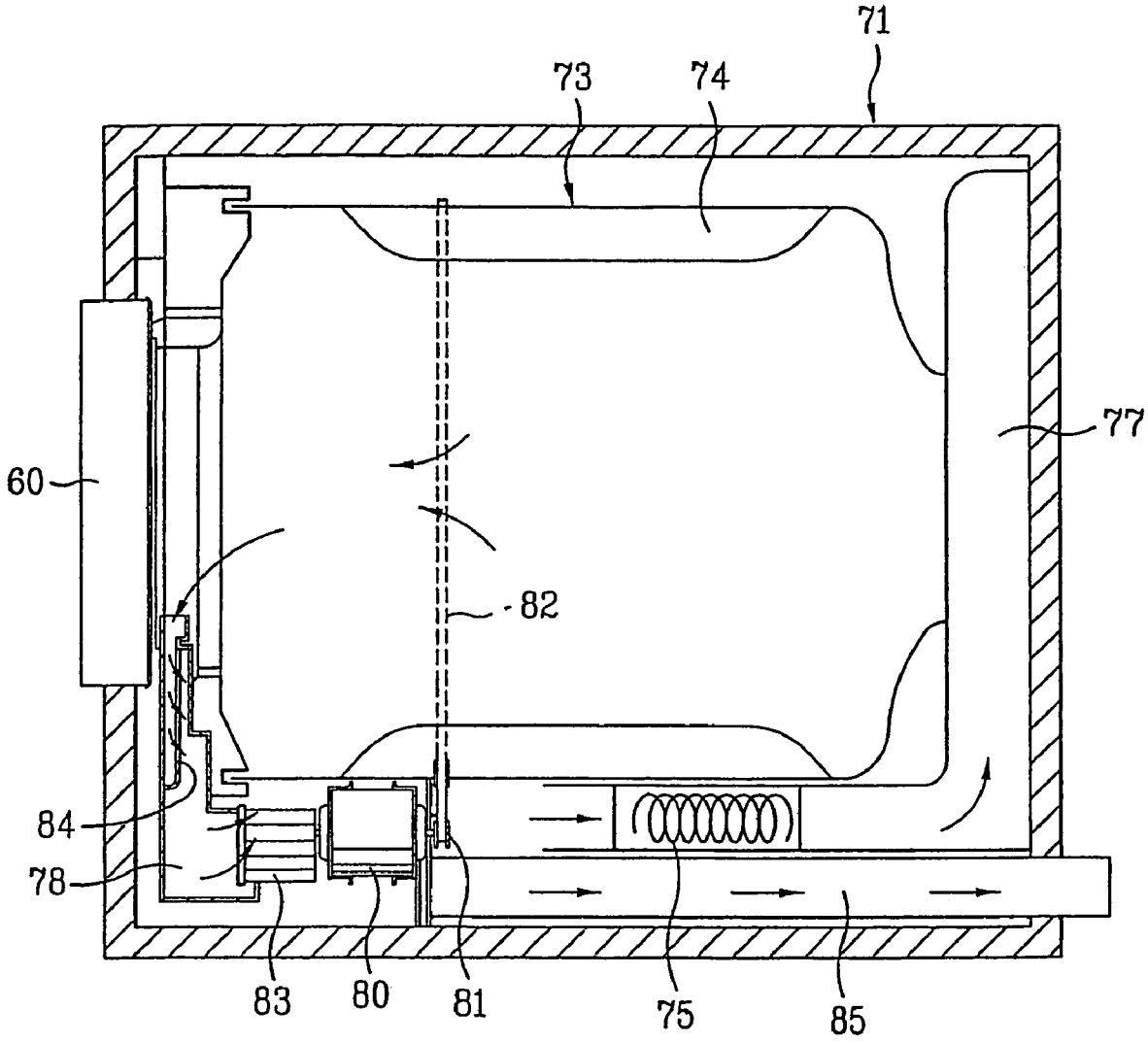
FIG. 3 illustrates a perspective view of a clothes drier having the door of the present invention applied thereto.

Referring to FIG. 3, the clothes drier of the present invention includes a cabinet 71, a drying drum 73, a driving device, a heater 75, a suction duct 77, a discharge duct 85, a lint duct 78, and a blower 83.

The drying drum 73 is rotatably mounted in a body 71, having a plurality of lifters 74 projected from an inside circumference surface thereof.

The driving device is fitted to provide a rotation force to the drying drum 73, and includes a motor 80, a driving pulley 81 connected to the motor 80, and a belt 82 connected to the driving pulley 81 and wound around an outer circumference of the drying drum 73.

When the driving device is put into operation, the driving pulley 81 and the belt 82 rotate at the same time as the motor 80 rotates, according to which the drying drum 73 is rotated.

The heater 75 is inside of the suction duct 77 for drawing and heating external air to produce hot air.

The suction duct 77 is connected to a rear opening in the drying drum 73, for drawing external air through an end, and guiding the hot air produced by the heater 75 toward an inside of the drying drum 73.

The discharge duct 85 is in communication with an exterior, and the lint duct 78 is in communication with the front opening of the drying drum 73 and the discharge duct 85 respectively, for guiding moist air having dried the drying object in the drying drum 73 toward the discharge duct 85. There is a filter 84 at an inlet to the lint duct 78 for filtering foreign matters, such as dust or fluff from the air from the drying drum 73. The blower 83 in rear of the lint duct 78 generates a blowing power and discharges the moist air guided to the discharge duct 85 to an exterior.

In the meantime, as described, the door 60 is provided in the front part of the cabinet 71.

The door of the present invention for the drum type washing machine and clothes drier will be described in more detail, with reference to the attached drawings.

Referring to FIG. 4, the door of the present invention includes a hinge assembly 15 for opening/closing the door 60, and an inner frame 62 and an outer frame 64 joined together having at least one thereof connected to the hinge assembly 15.

The inner frame 62 includes a hook 65 for opening/closing of the door 60, and a hole **62*h* for inserting the hook 65 therein. The outer frame 64 includes a recessed handle 70 for opening/closing the door 60**.

The inner frame 62 and the outer frame 64 are fastened with bolts 61, with a transparent door glass 63 fixed between the inner frame 62 and the outer frame 64. Accordingly, a circumference of the door glass 63 is fixed by the inner frame 62 and the outer frame 64.

Figure 5:
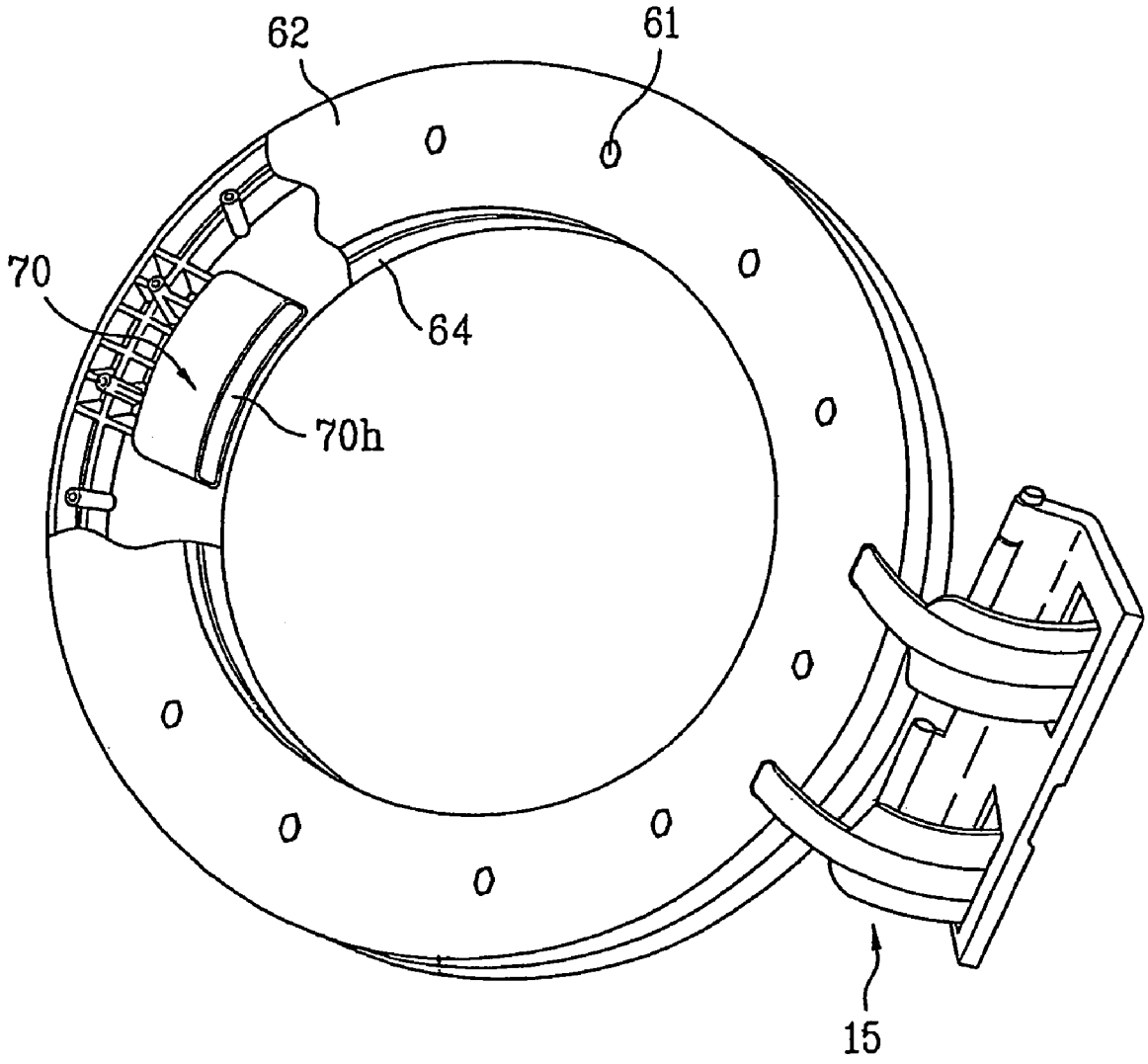
FIG. 5 illustrates a detailed perspective view of a handle of a door in accordance with a preferred embodiment of the present invention.

The handle 70 will be described in more detail. Referring to FIG. 5, the handle 70 includes a cavity **70*h* recessed into a thickness of an inner circumferential surface of the outer frame 64 with a depth and a width enough to put a user's hand therein in opening/closing the door 60**.

Therefore, an opening of the handle 70 is positioned in the inner circumferential surface of the outer frame 64, and the cavity **70*h* having the depth and the width is formed inside of the opening, which is an inside of the outer frame 64, such that the handle 70 is not visible in a front view of the door 60**.

Figure 6:
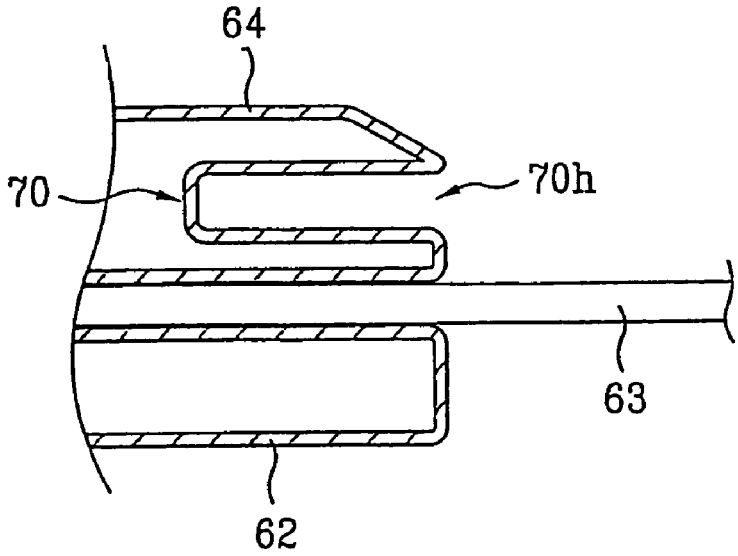
FIG. 6 illustrates a section of a handle in accordance with another preferred embodiment of the present invention.

According to this, it is required to change a shape of the outer frame 64 at which the handle 70 is formed, or put a mark thereon, for giving a notice of a position of the handle 70 to the user. To do this, as shown in FIG. 6, the inner circumferential surface of the outer frame 64 is sloped so as to expose the opening of the handle 70, or only a part of the inner circumferential surface of the outer frame 64 at which the handle 70 is positioned is sloped.

In the case only the part of the inner circumferential surface of the outer frame 64 is sloped, since the sloped part is the position of the handle 70, the position of the handle 70 can be known even if the opening of the handle 70 is not exposed.

Alternatively, for giving notice of a position of the handle 70, an outside surface of the outer frame 64 in which the handle 70 is formed may be formed of transparent plastic so that the position of the handle 70 is visible from outside of the outer frame 64.

Other than those methods, an exact position of the handle 70 may be marked by various methods, such as painting a particular color on the outside surface of the outer frame 64 at which the handle 70 is positioned, or marking a handle 70 thereon, for easy finding of the handle 70.

Since the handle 70 has the cavity **70*h* in the outer frame 64, the handle 70 is formed in the outer frame 64 at the same time with fabrication of the outer frame 64. That is, the handle 70 is fabricated, not separately from the outer frame 64, but as one unit with the outer frame 64**.

Figure 7:
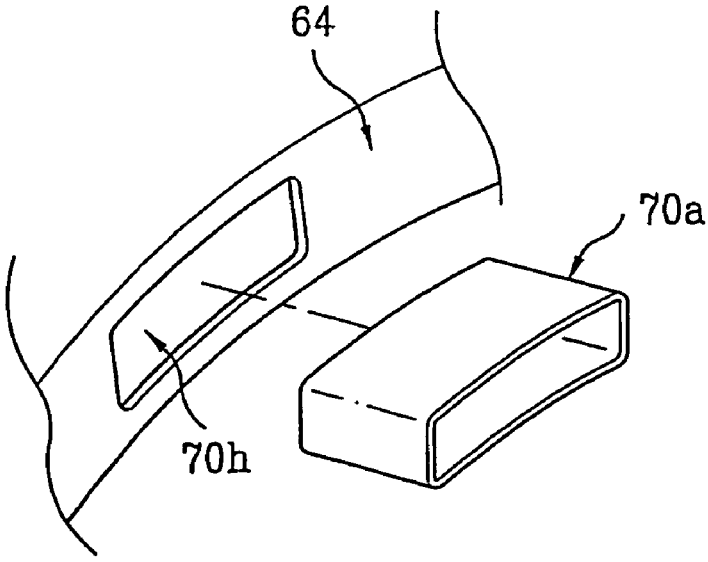
FIG. 7 illustrates a perspective view of a handle of the present invention fabricated separately.

However, referring to FIG. 7, the handle 70 may be fabricated, by forming the cavity **70*h* in conformity with the handle 70 in the inner circumferential surface of the outer frame 64 in fabrication of the outer frame 64, and inserting a handle 70***a* fabricated separately into the cavity 70*h* formed in the inner circumferential surface of the outer frame 64.

Or, alternatively, the handle 70 may be fabricated by forming a recess (not shown) having a depth and a width enough to put a hand and open/close the door, not in the inner circumferential surface, but in the surface of the outer frame 64 in fabrication of the outer frame 64, or by inserting a handle 70*a* fabricated separately into the recess formed in an outside surface.

Above method is favorable in view of fabrication because the cavity 70*h* is not formed in the outer frame 64, but a recess is formed in an outside of the outer frame 64.

In the case the handle 70*a* is thus fabricated separately, since the handle 70*a* is inserted in and fixed to the cavity 70*h* or recess in the outer frame 64, the handle 70*a* is made detachable.

Figure 8:
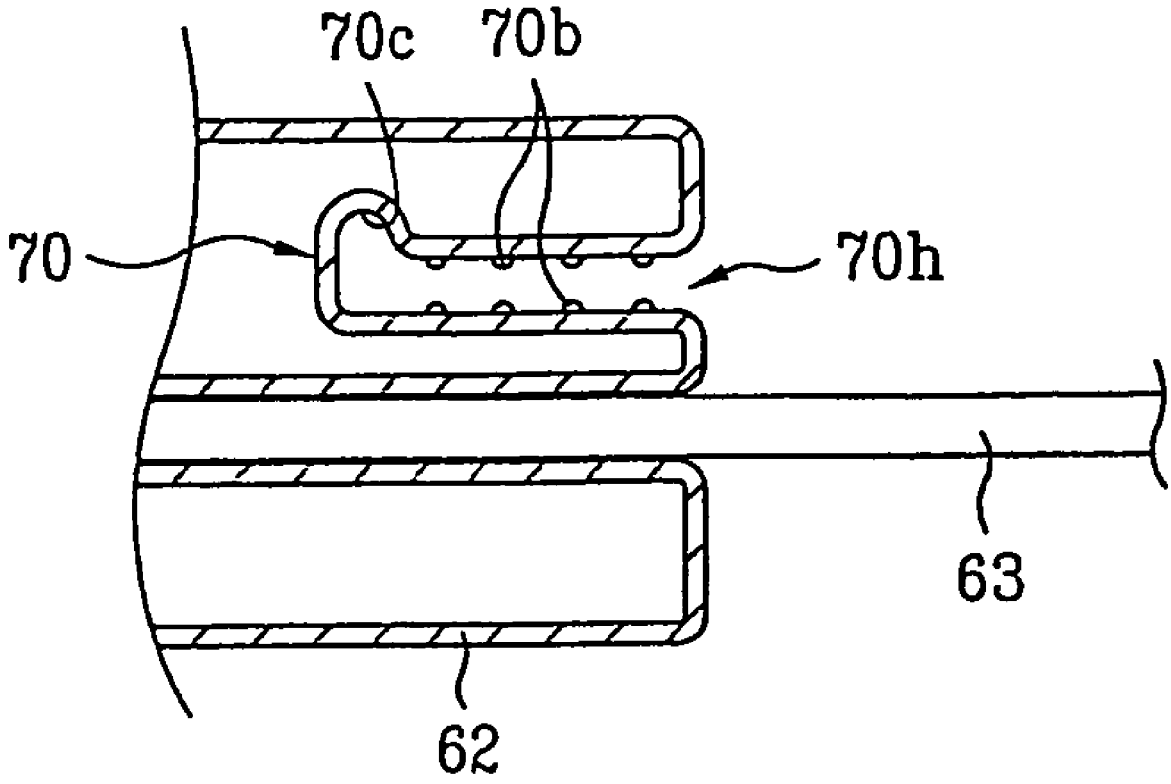
FIG. 8 illustrates a section of a handle in accordance with another preferred embodiment of the present invention.

Moreover, referring to FIG. 8, for easier opening/closing of the door 60, a surface of the handle 70 may be formed rugged, or projections are formed on the surface of the handle 70, for prevention of slipping of fingers, or a finger recess 70*c* may be formed in an inside of the handle 70 at which ends of the fingers are inserted and caught for easier opening/closing of the door 60.

The handle 70 may be formed in an inside surface of the outer frame 64, when the door glass 63 serves as a bottom of the handle 70. Accordingly, in this case, since the door glass 63 can be scratched due to contact with the fingers, as described, it is preferable that the handle 70*a* fabricated separately is employed, for avoiding direct contact of the fingers with the door glass 63.

Thus, the handle 70 may be provided in different parts of the outer frame 64, and there may be a variety of variations of the form of the handle 70.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

INDUSTRIAL APPLICABILITY

The present invention has the following advantages.

The door 60 of the present invention, and the drum type washing machine or the clothes drier having the door of the present invention applied thereto improve an entire appearance of the drum type washing machine or the clothes drier, because the handle 70 is not projected from the outer frame 64, thereby maintaining a shape of the door 60 as it was.

What is claimed is:

1. A washing appliance comprising:

a cabinet;

a tub mounted inside the cabinet;

a drum rotatably mounted in the tub;

a door attached to the cabinet, the door comprising:

an inner frame joined with an outer frame, wherein at least one of the frames couples with the cabinet of the washing appliance;

a glass door secured between the inner frame and the outer frame, the outer frame including an inner surface secured to the glass door, an outer surface on an exterior of the appliance and an inner circumferential surface extending upwardly from the inner surface to the outer surface; and a handle comprising a recess portion configured to receive a user's hand disposed in the inner circumferential surface of the outer frame.

2. The door as claimed in claim 1, wherein the outer frame has a ring shape.

3. The door as claimed in claim 1, wherein the outer frame is spaced from an upper surface of the door glass.

4. The door as claimed in claim 1, wherein the recess portion is integral with the outer frame.

5. The door as claimed in claim 4, including a separately fabricated handle located in the recess portion.

6. The door as claimed in claim 1, wherein the recess portion includes projections configured to minimize slip.

7. The door as claimed in claim 1, wherein the recess portion includes a stepped portion at an edge thereof.

8. The door as claimed in claim 1, including a separately fabricated handle located in the recess portion.

9. A washing appliance comprising:

a cabinet;

a tub mounted inside the cabinet;

a drum rotatably mounted in the tub;

a door attached to the cabinet the door comprising:

an outer frame coupled with the cabinet of the washing appliance, the outer frame having an inner circumferential surface, an inner frame joined with the outer frame, a glass door between the inner frame and the outer frame wherein the outer frame includes an inner surface secured to the glass door and an outer surface on the exterior of the appliance, wherein the inner circumferential surface extends upwardly from the inner surface to the outer surface; and a handle comprising an opening configured to receive a user's hand in the inner circumferential surface, the opening being positioned between the outer frame and the inner frame.

10. The door as claimed in claim 9, wherein the outer frame has a ring shape.

11. The door as claimed in claim 9, wherein the outer frame has an upper surface spaced from an upper surface of the glass door.

12. The door as claimed in claim 9, wherein the opening in the outer frame has a separately fabricated handle mounted therein.

13. The door as claimed in claim 12, wherein the handle is unitary with the opening in the outer frame.

14. The door as claimed in claim 12, wherein the separately fabricated handle is detachable.

15. The door as claimed in claim 9, further comprising an identifier which indicates a position of the opening.

16. The door as claimed in claim 15, wherein the identifier includes a sloped portion of the outer frame formed at a position corresponding to the opening.

17. The door as claimed in claim 15, wherein the identifier is formed in at least one of the outer frame and the door glass.

18. The door as claimed in claim 1, wherein the recess portion is disposed in a thickness of the inner circumferential surface of the outer frame.

19. The door as claimed in claim 1, wherein the recess portion is disposed between an upper surface and a lower surface of the outer frame.

20. The door as claimed in claim 1, wherein the handle does not protrude from the inner circumferential surface of the outer frame so that the handle does not hide the door glass.

21. The door as claimed in claim 9, wherein the opening is disposed in a thickness of the inner circumferential surface of the outer frame.

22. The door as claimed in claim 9, wherein the opening is disposed between the inner surface and the outer surface of the outer frame.

23. The door as claimed in claim 9, wherein the handle does not protrude from the inner circumferential surface of the outer frame so that the handle does not hide the door glass.

* * * * *